United States Patent [19]

Baird

[11] Patent Number: 4,724,647

[45] Date of Patent: Feb. 16, 1988

[54] DIAGONAL CEILING BRACE

[76] Inventor: Carey F. Baird, 6354 Lawrie Ave., Rialto, Calif. 92376

[21] Appl. No.: 9,257

[22] Filed: Jan. 30, 1987

[51] Int. Cl.[4] ..... E04G 25/00

[52] U.S. Cl. ..... 52/127.2; 52/657; 52/693; 52/695

[58] Field of Search ..... 52/127.2, 657, 693, 52/695

[56] References Cited

U.S. PATENT DOCUMENTS

| | | | |
|---|---|---|---|
| 1,735,590 | 11/1929 | White | 52/695 |
| 1,849,273 | 3/1932 | Broderick | 52/657 |
| 2,914,813 | 12/1959 | Christian et al. | 52/127.2 |
| 3,788,026 | 1/1974 | Cook | 52/127.2 |
| 4,067,157 | 1/1978 | Robinson | 52/127.2 |
| 4,304,078 | 12/1981 | Meriwether, Jr. | 52/127.2 |
| 4,441,289 | 4/1984 | Ikuo et al. | 52/657 X |
| 4,524,554 | 6/1985 | Simpson | 52/693 |

*Primary Examiner*—Alfred C. Perham
*Attorney, Agent, or Firm*—Harvey S. Hertz

[57] ABSTRACT

A diagonal ceiling brace for ceiling suspension systems. The ceiling suspension system contains a plurality of parallel longitudinal beams and a plurality of parallel cross beams. The longitudinal beams and the cross beams are connected to each other at intersecting junctions. The diagonal ceiling brace comprises an elongated main bar having a horizontal plate formed at each end thereof. Each horizontal plate has a front edge containing a pair of surfaces defining a generally 90° angle for enabling the plate to abut a junction of one of the longitudinal beams and one of the parallel cross beams. A releasable hook locks the brace to the beams at the junction.

4 Claims, 5 Drawing Figures

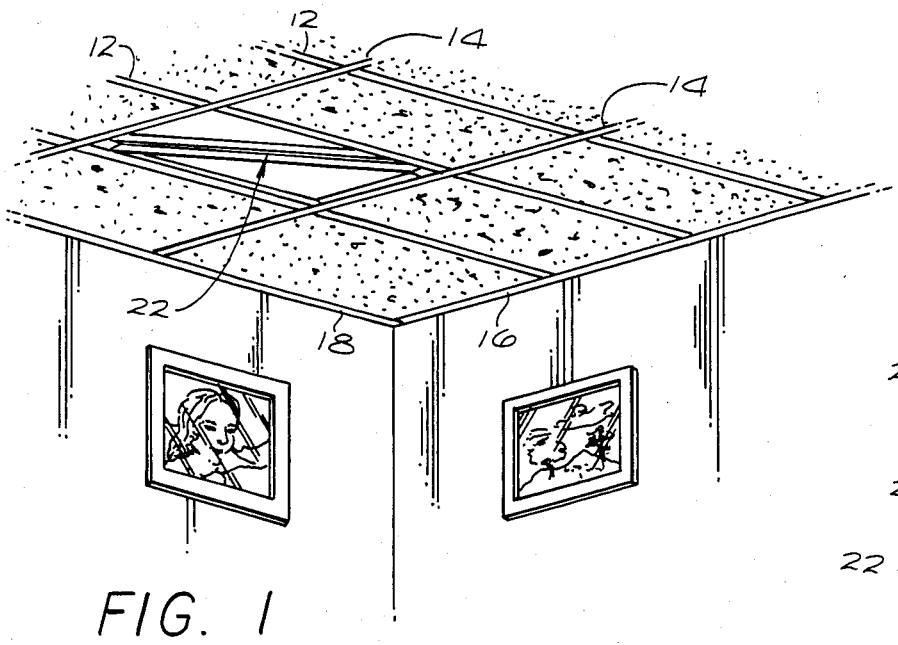
FIG. 1
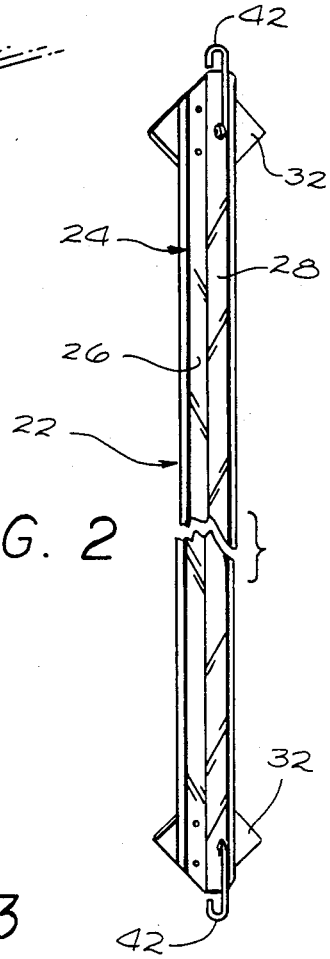
FIG. 2
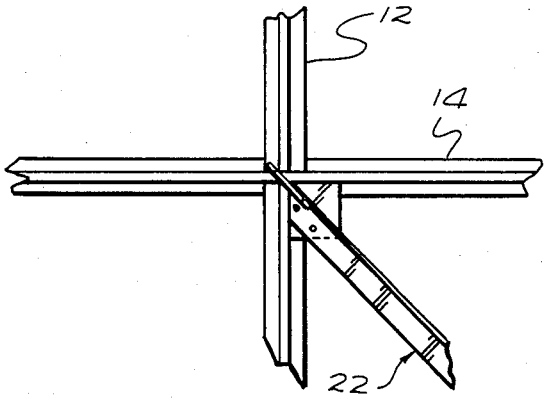
FIG. 3
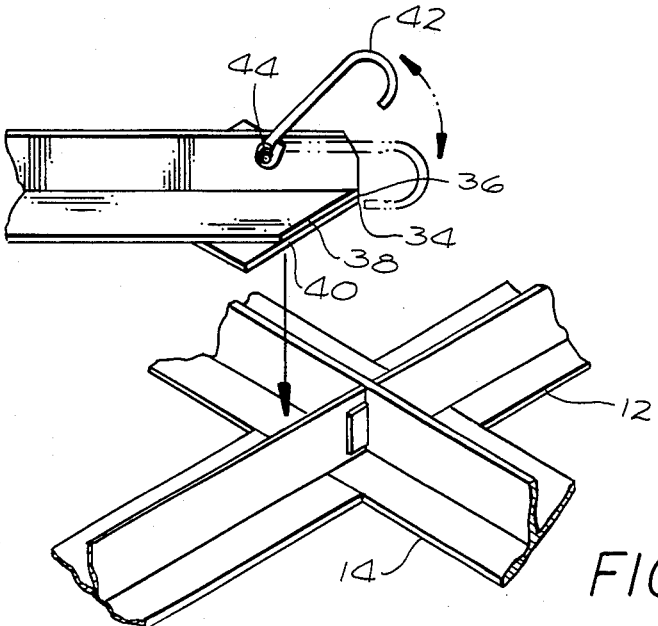
FIG. 4
FIG. 5
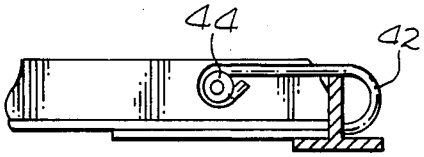

DIAGONAL CEILING BRACE

BACKGROUND OF THE INVENTION

1. Field of the Invention

The field of art to which the invention pertains includes the field of ceiling suspension systems, and more particularly, to a removable diagonal ceiling brace which can be temporarily mounted during the installation of the ceiling suspension system.

2. Description of the Prior Art

Ceiling suspension systems are used primarily in office buildings where temporarily ceiling panels are installed. Typically, the ceiling suspension systems consists of a grid containing a plurality of pairs of parallel beams which intersect at junctions. During the installation of the parallel beams, it is necessary to be certain that the beams remain parallel until final attachment of the grid to the building walls.

Known prior art includes U.S. Pat. Nos. 3,302,355; 4,524,554; 3,793,790; 3,204,383; 3,590,544; 4,583,340; 3,089,570 and 3,736,706.

SUMMARY OF THE INVENTION

A diagonal ceiling brace for ceiling suspension systems having a plurality of parallel longitudinal beams and a plurality of parallel cross beams. The longitudinal beams and the cross beams are connected to each other at intersecting junctions. The brace comprises an elongated main bar having a horizontal plate formed at each end thereof. The plate front edge has a pair of surfaces defining a generally 90° angle for enabling the plates to abut the junction of one of the longtitudinal beams and one of the parallel cross beams. A releasable hook is secured to the brace for interlocking the brace to the beams at the junction.

The advantages of this invention, both as to its construction and mode of operation, would be readily appreciated as the same becomes better understood by reference to the following detail description when considered in connection with the accompanying drawings in which like reference numerals designate like parts throughout the figures.

BRIEF DESCRIPTION OF THE DRAWINGS

FIG. 1 is a perspective view illustrating the mounting of the diagonal ceiling brace in a ceiling suspension system;

FIG. 2 is a perspective view of the diagonal ceiling brace of FIG. 1;

FIG. 3 is a top plan view illustrating the interconnection of the diagonal ceiling brace of FIG. 1;

FIG. 4 is a view illustrating the positioning of the diagonal ceiling brace of FIG. 1; and FIG. 5 is a partial cross-sectional view illustrating the diagonal ceiling brace in a locked position.

DESCRIPTION OF THE PREFERRED EMBODIMENTS

Referring now to the drawings, there is shown in FIG. 1, a ceiling suspension system constructed in accordance with principles of the invention. The ceiling suspension system includes a plurality a parallel longitudinal beams 12 and a plurality of intersecting parallel cross beams 14. The longitudinal beams 12 and the parallel cross beams 14 are each secured at their ends to end walls of a building, one end wall 16 and one end wall 18, respectively, being shown in FIG. 1

During the mounting of the ceiling suspension system it has been found that prior to the final securing of the parallel longitudinal beams 12 and the parallel cross beams 14, movement occurs which causes the longitudinal beams 12 and cross beams 14 to move so that the result may be non-parallel configuration. In instances where the beams 12 and 14 are used to support false ceiling panels, this would prevent standard ceiling panels from being positioned thereon and being supported by the suspension system.

In the present invention, a plurality of diagonal ceiling braces 22, one of whichis shown in FIG. 1 is utilized to keep each of the longitudinal beams 12 and the cross beams 14 in a parallel configuration. Thus, the longitudinal beams 12 and the cross beams 14 will intersect each other at right angles when installation is completed.

As shown in FIG. 2, the diagonal ceiling brace 22 is formed of a generally L-shaped main bar 24 having a horizontal section 26 and a vertical section 28. A generally square horizontal end plate 32 is secured to the bottom of the horizontal section 26. Typically, the horizontal end plate 32 can be riveted or otherwise secured to the vertical section 28. The end plate 32 is positioned so that its front tip 34 (as shown in FIG. 4) is adjacent the end 36 of the main bar horizontal section 26 and the vertical section 28 junction.

The conventional ceiling longitudinal beams 12 and cross beams 14 have been illustrated in FIGS. 3 and 4 as being generally of a T-shaped configuration. In this manner, the beams 12 and 14 slidably interlock with each other as can be seen in FIG. 4. It should be noted that main bar 24 horizontal section 26 has been cut as seen in FIG. 4 so that its edge 38 is tapered in the same plan as the edge 40 of the end plate 32.

Once the diagonal brace 22 has been positioned at intersections of a longitudinal beam 12 and a cross beam 14, (FIG. 1), a pivotable hook 42, which is secured at one end 44 to the vertical section 28, is rotated (FIG. 3), so that the hook interlocks with the junction of the longitudinal beam 12 and the cross beam 14 at the intersection diagonally opposite to where the end plate 32 is positioned, as can be seen in FIG. 4 and 5. In this manner, the parallel longitudinal beams 12 and the parallel cross beams 14 can be correctly aligned prior to the final securing of these beams to their respective end walls. Once the beams 12 and 14 have been secured to the end walls, the pivotable hooks 42 are rotated back so that the diagonal ceiling brace 22 can be removed and utilized in another ceiling structure.

It should be understood that the present invention utilizes a diagonal ceiling brace 22 of L-shaped configuration. However, other configurations of course could be utilized. For example the ceiling brace 22 could be of T-shaped configuration as well.

I claim:

1. A removable diagonal ceiling brace for ceiling suspension systems having a plurality of parallel longitudinal beams and a plurality of parallel cross beams, said longitudinal beams and said cross beams being connected to each other at intersection junctions, said brace comprising:

a temporarily installed elongated main bar having a horizontal plate formed at each end thereof, said plate front edge having a pair of surfaces defining a generally 90° angle for enabling said plate to abut a junction of one of longitudinal beams and one of said cross beams; and means for temporarily securing said brace to said beams consisting of a releasable hook for interlocking said brace to said beams at said junction for enabling said beams to remain parallel until said beams are affixed to a permanent structure.

2. A diagonal ceiling brace in accordance.with claim 1 wherein said hook is pivotable so as to move from side of said intersecting junction to the other side thereof.

3. A diagonal ceiling brace in accordance with claim 1 wherein said main bar is of L-shaped configuration.

4. A diagonal ceiling brace in accordance with claim 1 wherein said main bar includes a horizontal section formed adjacent said horizontal plate, said horizontal section having an edge formed in the same plane as said horizontal edge front plate.

* * * * *